US012419418B1

(12) United States Patent
Wohlman

(10) Patent No.: US 12,419,418 B1
(45) Date of Patent: Sep. 23, 2025

(54) SUSPENDED SHELVING APPARATUS

(71) Applicant: Thomas Wohlman, Denver, CO (US)

(72) Inventor: Thomas Wohlman, Denver, CO (US)

( * ) Notice: Subject to any disclaimer, the term of this patent is extended or adjusted under 35 U.S.C. 154(b) by 0 days.

(21) Appl. No.: 18/732,191

(22) Filed: Jun. 3, 2024

(51) Int. Cl.

| | |
|---|---|
| ***A47B 96/07*** | (2006.01) |
| ***A47B 43/00*** | (2006.01) |
| ***A47B 57/00*** | (2006.01) |
| ***A47F 5/00*** | (2006.01) |
| ***A47F 5/08*** | (2006.01) |
| ***A47G 7/04*** | (2006.01) |

(52) U.S. Cl.
CPC ..... *A47B 96/07* (2013.01); *A47B 43/006* (2013.01); *A47B 57/00* (2013.01); *A47F 5/0093* (2013.01); *A47F 5/0892* (2013.01); *A47G 7/044* (2013.01)

(58) Field of Classification Search
CPC . A47B 96/07; A47B 23/007; A47B 2005/003; A47B 43/003; A47B 43/006; A47B 2051/005; A47H 27/00; A47G 7/044; A47G 7/04; A47G 7/042; A47G 7/045; A47F 5/0043; A47F 7/0078; A47F 5/0093; A47F 5/0892
USPC .... 211/113, 85.29, 117, 88.03, 85.23, 90.01, 211/90.02; 108/49; 248/340, 343, 250
See application file for complete search history.

(56) References Cited

U.S. PATENT DOCUMENTS 807,257 A * 12/1905 Fennel ..... A47B 43/006 248/245
859,601 A * 7/1907 Gibson ..... A47B 46/005 211/180
957,324 A * 5/1910 Gall ..... E04G 5/043 248/245
1,738,030 A * 12/1929 Bebb ..... F27B 9/2461 432/259
2,051,241 A * 8/1936 Biggers ..... A47G 7/045 211/88.03
2,357,118 A 8/1944 Kent
3,579,938 A * 5/1971 Hanson ..... E04F 21/05 52/700
3,610,426 A * 10/1971 Thomas ..... A47B 61/003 211/117
3,760,742 A 9/1973 Roloff
3,990,665 A * 11/1976 Joussemet ..... A47B 43/006 52/39
4,061,092 A * 12/1977 Jacobsen ..... A47B 43/006 52/39
4,108,084 A * 8/1978 Fink ..... A47B 61/003 108/29
4,167,908 A 9/1979 Jones
4,188,891 A 2/1980 Boyajian
4,254,881 A * 3/1981 Hard ..... A47B 57/585 211/113
4,317,522 A * 3/1982 Garrett ..... A47F 5/0892 211/113
4,746,021 A 5/1988 Helmholdt
(Continued)

FOREIGN PATENT DOCUMENTS

JP WO2020095571 9/2021

*Primary Examiner* — Jennifer E. Novosad

(57) ABSTRACT

A suspended shelving apparatus for slidably supporting items below a ceiling includes a rail, a plurality of support members, and a shelf. Each support member of the plurality of support members is coupled to and extends downwardly away from the rail to the shelf. Each support member of the plurality of support members is slidable along the rail to move the shelf along a path parallel to the rail.

12 Claims, 8 Drawing Sheets

(56) References Cited

U.S. PATENT DOCUMENTS 5,076,446 A * 12/1991 Simmerman ..... A47F 5/0093 211/113
5,402,979 A * 4/1995 Bellamy ..... B60R 11/00 182/127
5,501,345 A * 3/1996 Hilstolsky ..... A47G 25/1457 211/116
5,601,016 A * 2/1997 Witte ..... A47B 43/003 108/106
5,749,479 A * 5/1998 Belokin ..... A47F 5/0892 211/113
6,098,815 A * 8/2000 Nesser ..... A47B 61/04 211/38
6,161,709 A * 12/2000 Kluge ..... A47B 57/40 108/107
6,227,387 B1 * 5/2001 Rose ..... A47J 47/16 211/113
6,484,893 B1 * 11/2002 Tkatch ..... A47F 3/063 211/94.01
7,228,669 B1 * 6/2007 Yaraschefski ..... A47B 5/00 52/39
7,293,664 B2 * 11/2007 Belokin ..... A47F 5/0892 211/113
7,401,705 B2 * 7/2008 Craft ..... A47B 96/00 211/113
7,832,568 B2 * 11/2010 Wu ..... A47B 81/04 211/85.29
8,517,326 B2 * 8/2013 Kelley ..... F24F 13/32 52/39
D725,399 S 3/2015 Wang
12,232,616 B2 * 2/2025 Thrush ..... B25H 3/04
2004/0020138 A1 * 2/2004 Grearson ..... E01D 19/106 52/64
2010/0224582 A1 * 9/2010 Loy, II ..... A47B 53/00 211/151
2010/0282698 A1 11/2010 Scheid
2013/0093298 A1 * 4/2013 Ehmke ..... A47B 45/00 312/204
2014/0252932 A1 * 9/2014 Higashi ..... E06B 5/006 312/301
2021/0347567 A1 11/2021 Torazawa
2022/0154503 A1 * 5/2022 Kenyon ..... E05D 15/0656

* cited by examiner

SUSPENDED SHELVING APPARATUS

(g) BACKGROUND OF THE INVENTION

(1) Field of the Invention

The disclosure relates to shelving units and more particularly pertains to a new shelving unit for slidably supporting items below a ceiling.

(2) Description of Related Art Including Information Disclosed Under 37 CFR 1.97 and 1.98

Various shelving units are disclosed by the prior art, including at least some which slidably support items below a ceiling. However, the prior art fails to describes such an apparatus in which uses a plurality of equally spaced support members that hang from a rail and a plurality of equally spaced ceiling mounts which are usable to mount the rail to the ceiling, and in which a spacing of the support members is equal to a spacing of the ceiling mounts.

(h) BRIEF SUMMARY OF THE INVENTION

An embodiment of the disclosure meets the needs presented above by generally comprising a rail, a plurality of support members, and a shelf. Each support member of the plurality of support members is coupled to and extends downwardly away from the rail to the shelf. Each support member of the plurality of support members is slidable along the rail to move the shelf along a path parallel to the rail.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
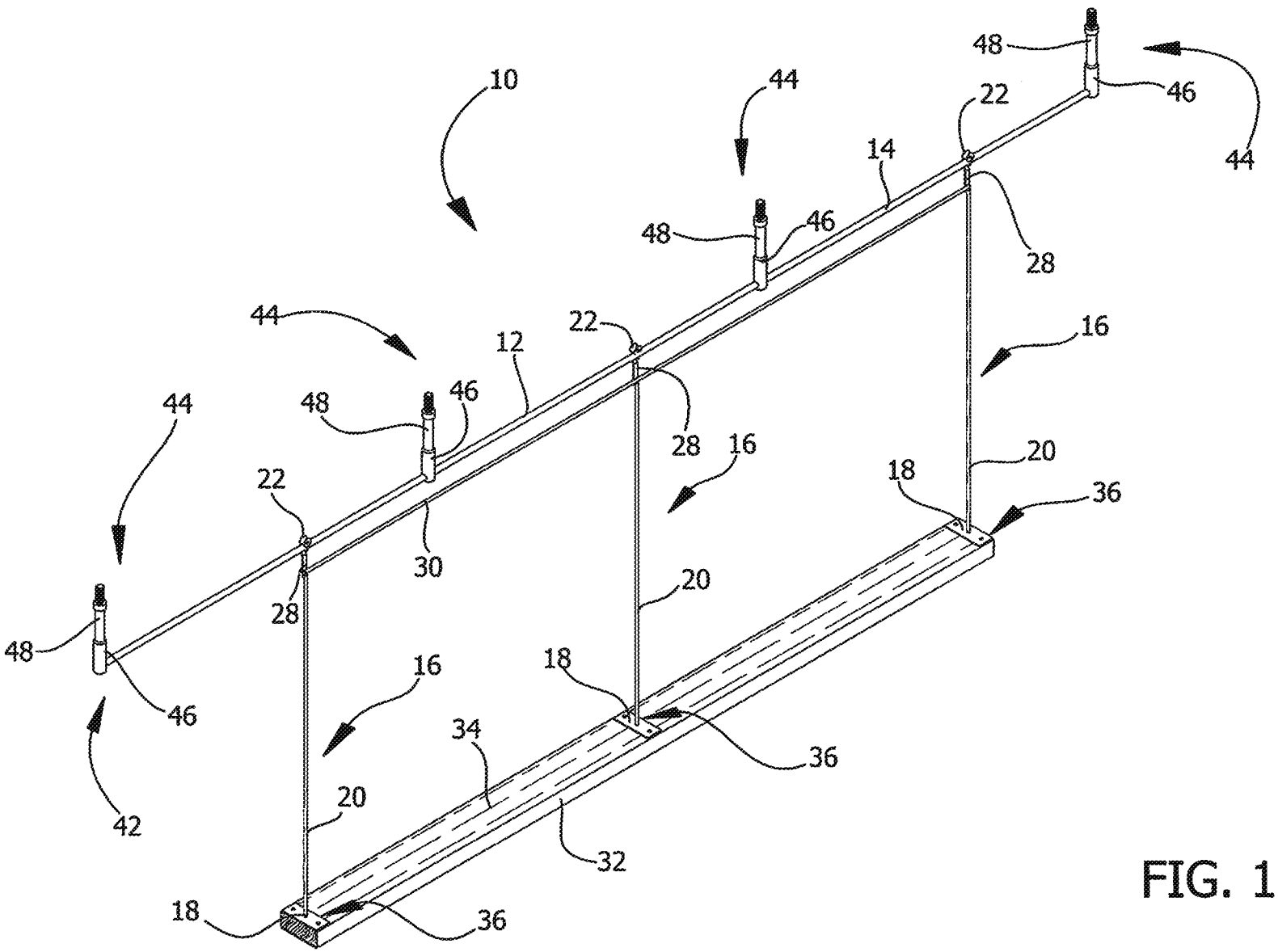
FIG. 1 is a perspective view of a suspended shelving apparatus according to an embodiment of the disclosure.
Figure 2:
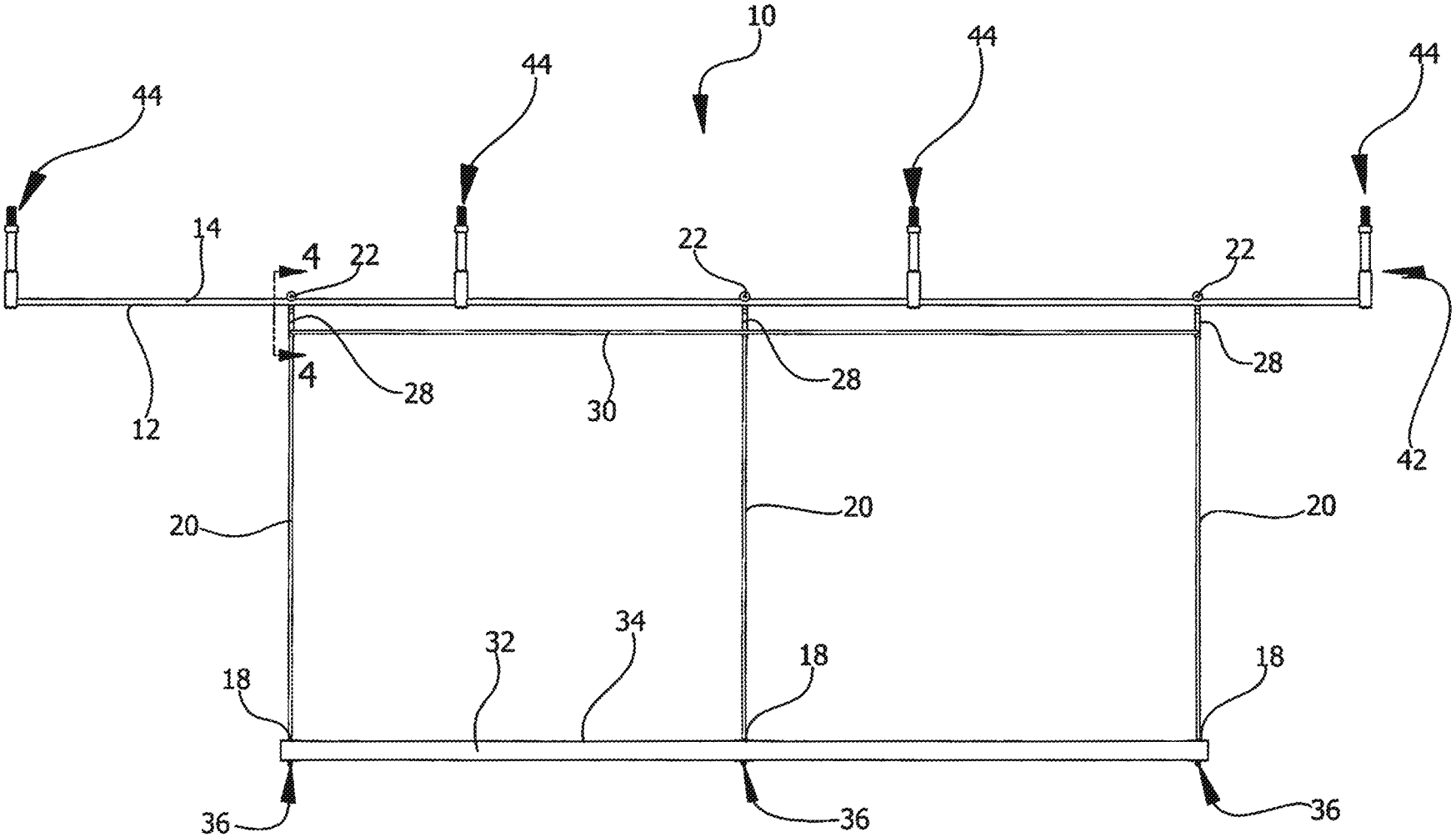
FIG. 2 is a front view of an embodiment of the disclosure.
Figure 3:
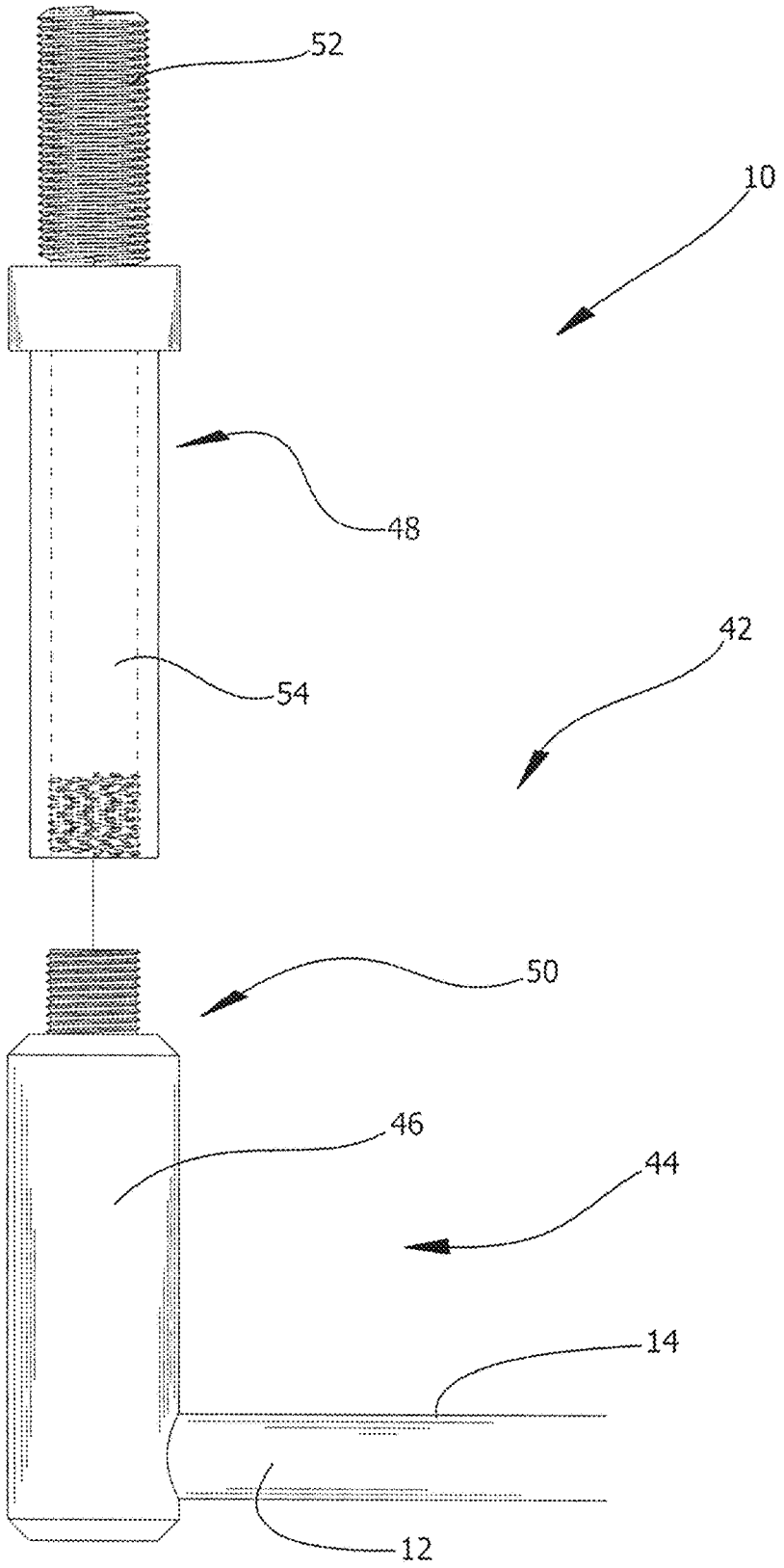
FIG. 3 is a detail exploded view of a mount assembly of an embodiment of the disclosure.
Figure 4:
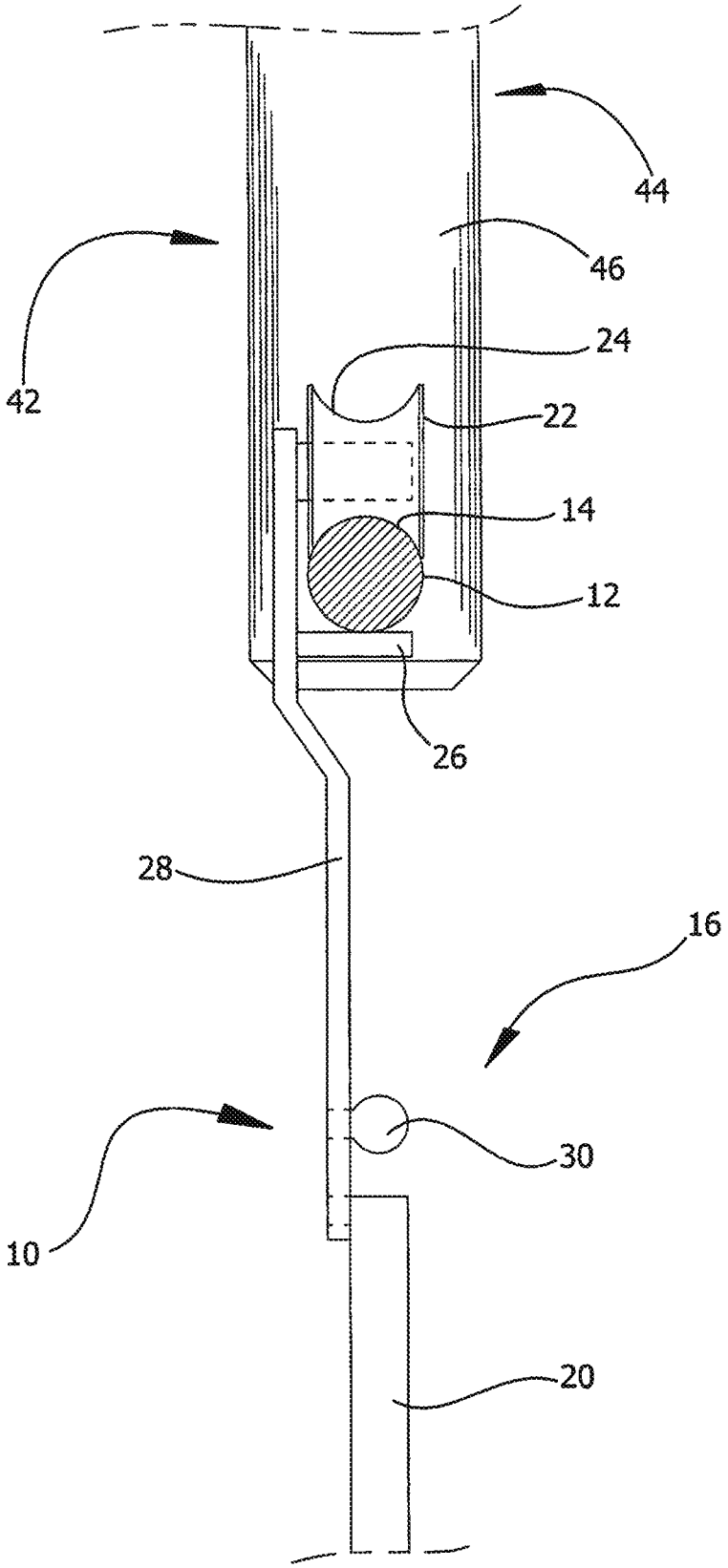
FIG. 4 is a cross-section view of an embodiment of the disclosure taken from Line 4-4 in FIG. 2.
Figure 5:
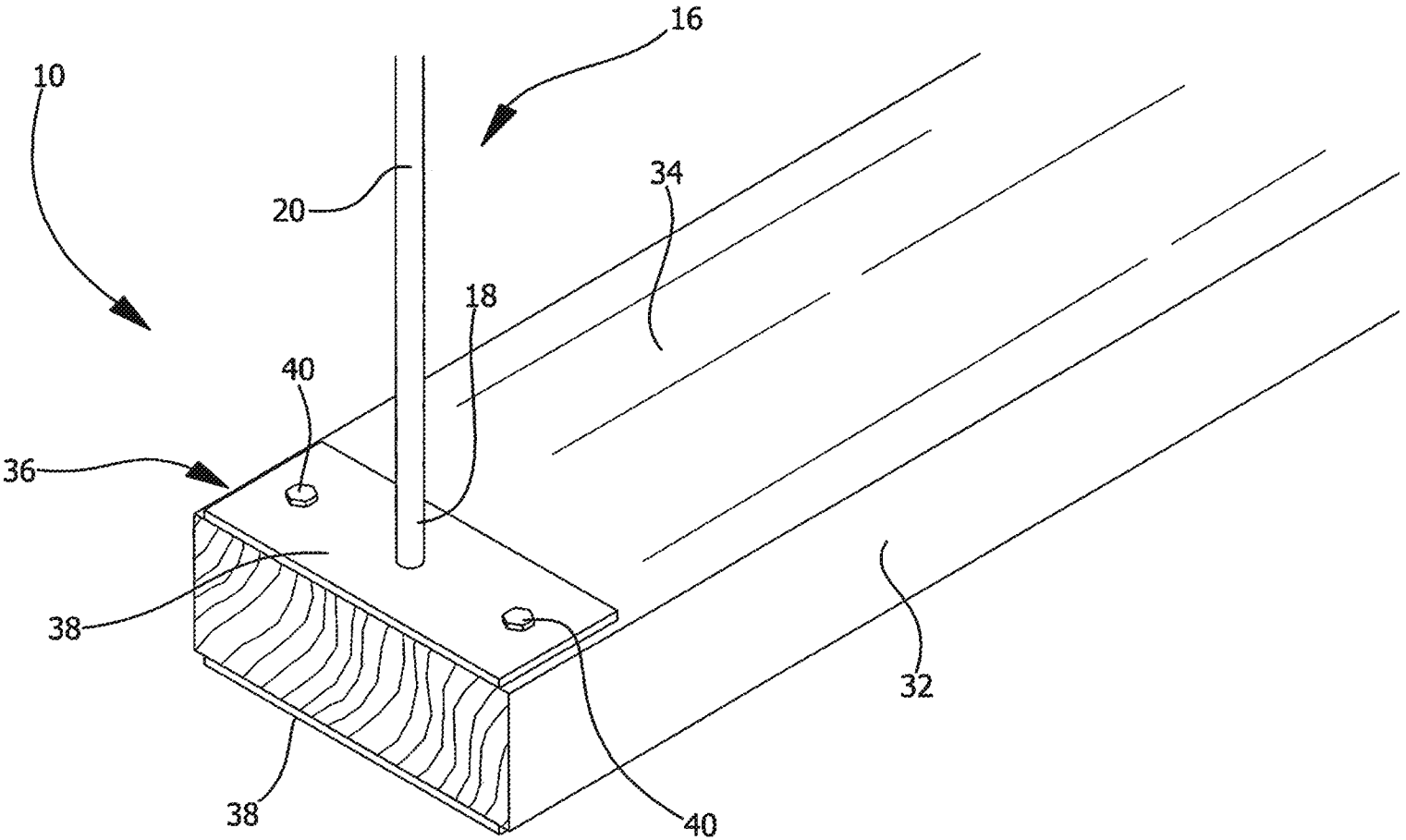
FIG. 5 is a detail perspective view of a connector between a support member and a shelf of an embodiment of the disclosure.
Figure 6:
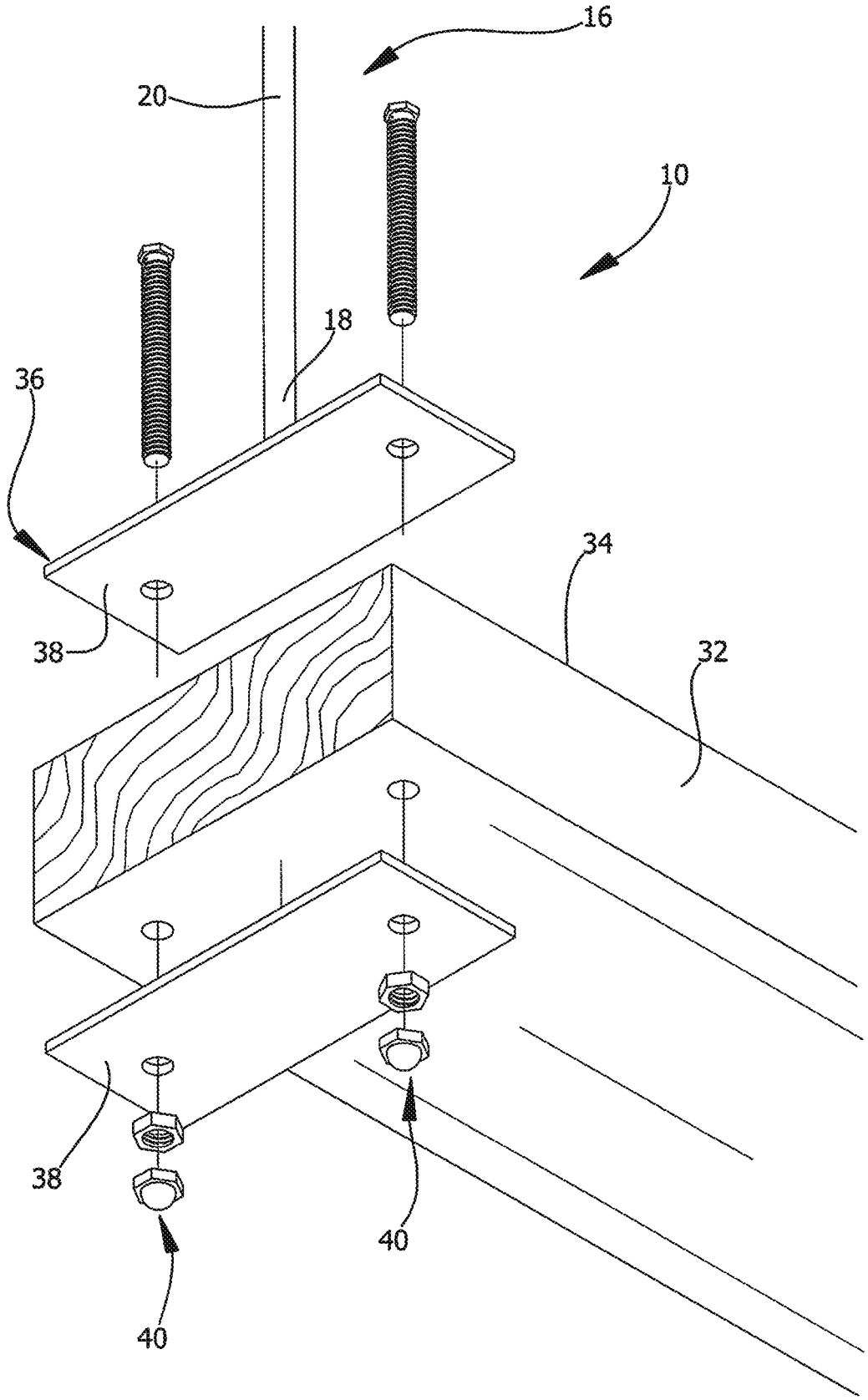
FIG. 6 is a detail exploded view of an embodiment of the disclosure.
Figure 7:
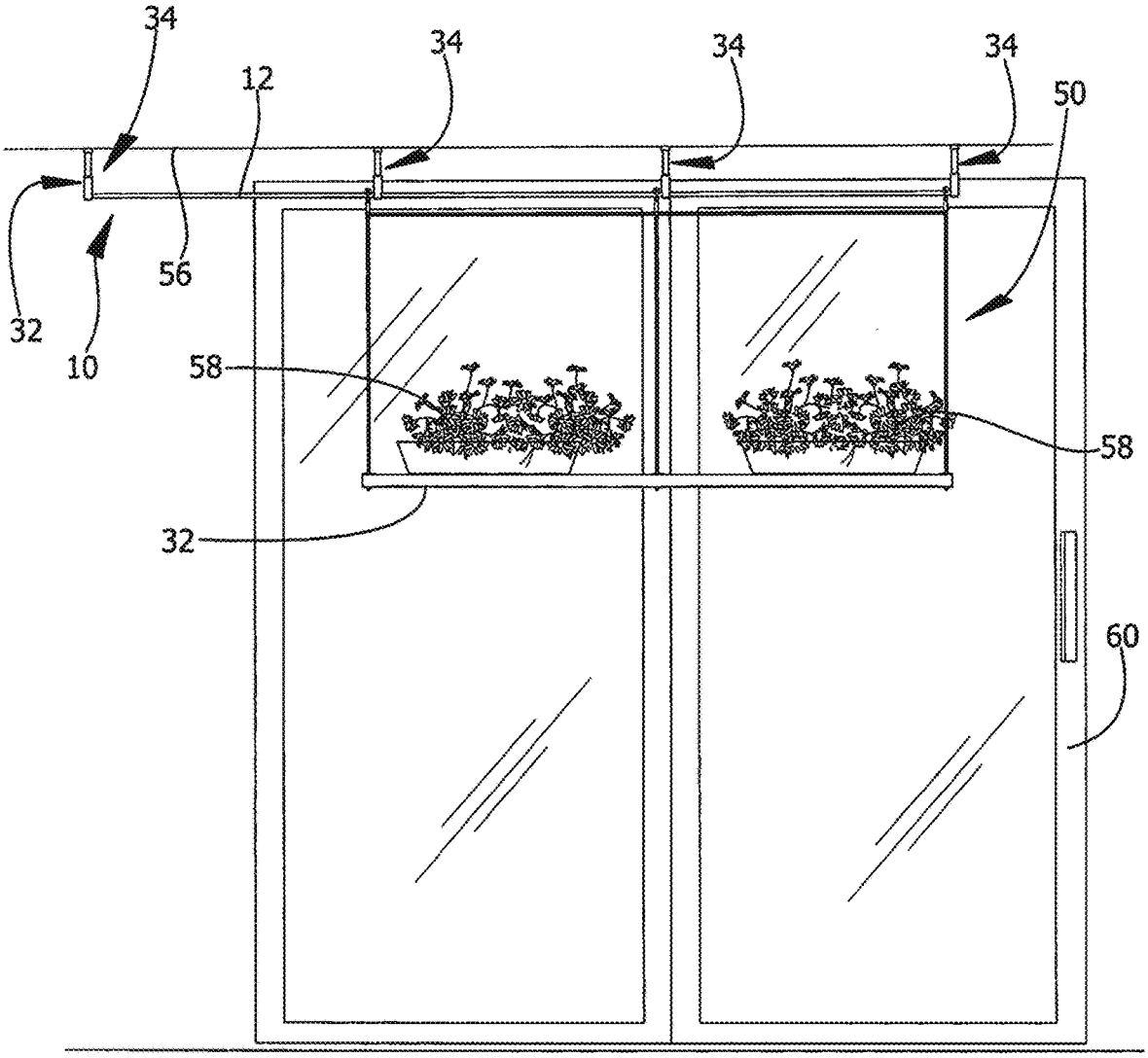
FIG. 7 is an in-use view of an embodiment of the disclosure with a shelf positioned in front of a door.
Figure 8:
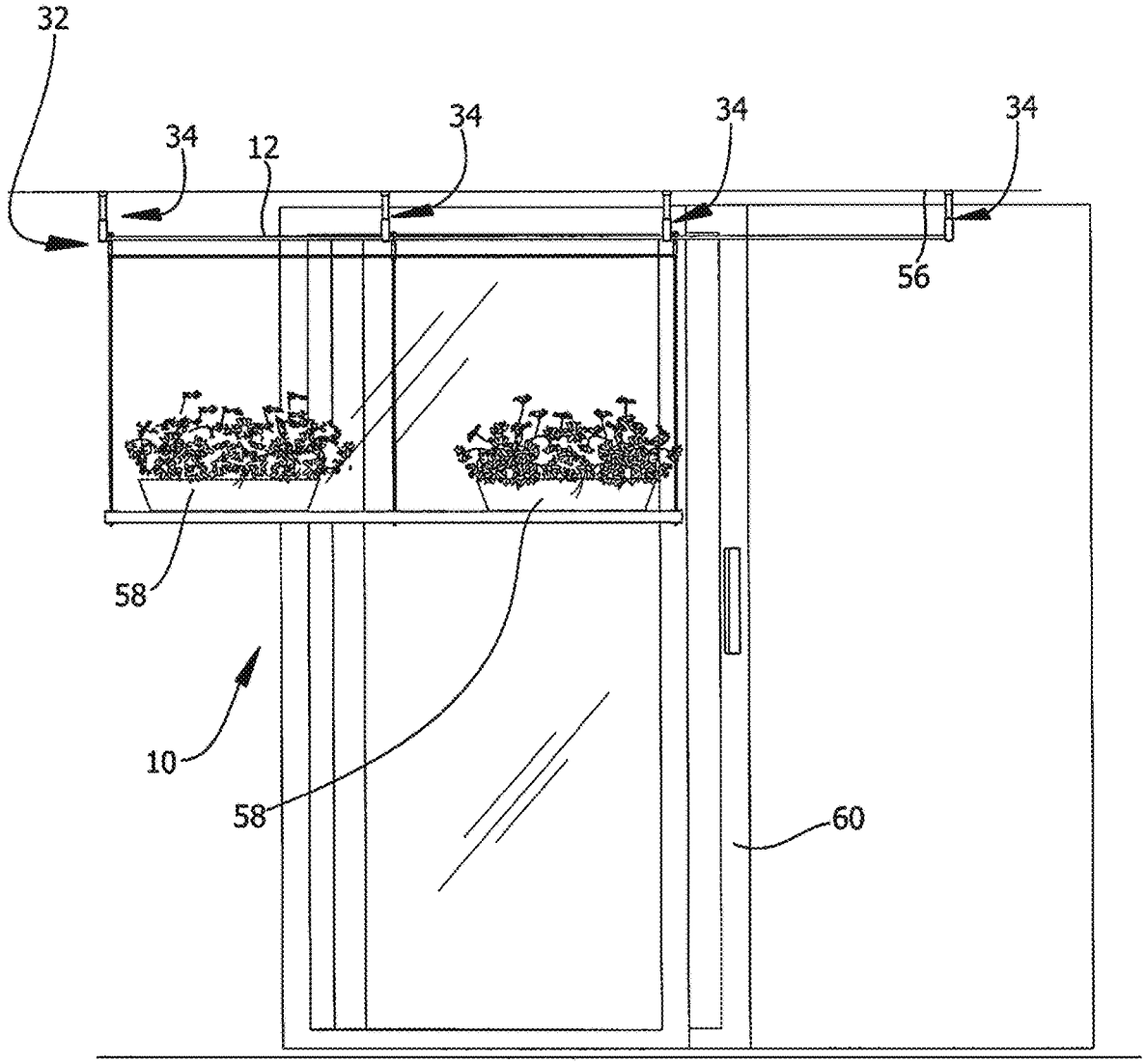
FIG. 8 is an in-use view of an embodiment of the disclosure with a shelf moved away from in front of a door.

With reference now to the drawings, and in particular to FIGS. 1 through 8 thereof, a new shelving unit embodying the principles and concepts of an embodiment of the disclosure and generally designated by the reference numeral 10 will be described.

As best illustrated in FIGS. 1 through 8, the suspended shelving apparatus 10 generally comprises a rail 12 which follows a substantially linear path. A plurality of support members 16 is slidably mounted to the rail 12. The support members 16 are fixed with respect to and equally spaced from each other. A lateral support beam 30 couples the support members 16 to each other. Each support member 16 comprises a rod 20, a roller 22, and a retainer member 26. The rod 20 hangs from the rail 12 via the roller 22, which engages a support surface 14 of the rail 12 and is rollable along the rail 12 to slide the plurality of support members 16 along the rail 12. The retainer member 26 of each support member 16 is positioned opposite the respective roller 22 across the rail 12 and engages the rail 12 to keep the respective roller 22 in engagement with the rail 12.

Each support member 16 also comprises a bracket 28 which couples the respective roller 22, rod 20, and retainer member 26 together. In other embodiments, the retainer member 26 and the roller 22 may be directly attached to the rod 20. A perimeter surface 24 of the roller 22 interlocks with the support surface 14 to further secure the roller 22 to the rail 12. The perimeter surface 24 is concave such that the rail 12 is received into a cavity formed by the perimeter surface 24. In other embodiments, the rail 12 may be concave and may receive the roller 22 therein.

A shelf 32 is coupled to a bottom end 18 of each support member 16 of the plurality of support members 16. The shelf 32 is elongated in a direction parallel to the rail 12. An upper surface 34 of the shelf 32 is flat such that it may support plants or other items 58 thereon. The shelf 32 may be constructed of wood or any other suitable material. Each support member 16 is attached to the shelf 32 via one of a plurality of connectors 36 which includes a pair of plates 38 positioned on opposite sides of the shelf 32 and a pair of nut-and-bolt assemblies 40. Any other suitable fastening means may be used.

In some embodiments, each support member 16 also comprises an actuator such as a linear actuator to alternately raise and lower the shelf 32. The support members 16 of some embodiments may also include one or motors which is operably coupled to one or more of the rollers 22 of the support members 16. By operating the one or more motors, the one or more rollers 22 may be rotated to move the shelf 32 parallel to the rail 12.

A ceiling mount 42 is coupled to the rail 12 and comprises a plurality of mount assemblies 44. The mount assemblies 44 are equally spaced from each other at a spacing equal to a spacing between each adjacent pair of support members 16 of the plurality of support members 16. Each mount assembly 44 of the plurality of mount assemblies 44 comprises a rail member 46 and a ceiling member 48. The rail member 46 is coupled to and extends away from the rail 12. The ceiling member 48 is removably coupled to the rail member 46 via a threaded coupling 50. Any other suitable coupling also may be used. The ceiling member 48 also has a threaded distal end 52 with respect to the rail member 46 such that the ceiling member 48 is configured to mount to a ceiling 56 via screwing the ceiling member 48 into the ceiling 56. A lower portion 54 of each ceiling member 48 may rotate with respect to its threaded distal end 52 to facilitate attachment to the rail member 46 after mounting to the ceiling 56. In other embodiments, the ceiling members 48 may attach to the ceiling 56 via nails, independent threaded fasteners, or any other suitable fastening means.

In use, the ceiling mount 42 is mounted to the ceiling 56. Items 58 such as plants may be placed on the upper surface 34 of the shelf 32 to support the items 58 in suspension below the ceiling 56. The shelf 32 is movable along the rail 12, and the mount assemblies 44 act as stops to the support members 16 to retain the shelf 32 between two ends of a pathway below the rail 12. The suspended shelving apparatus 10 may be used in front of a window or a door 60. Used in this manner, the items 58 may be stored in front of the window or door 60 if desired, for example, to expose the items 58 to sunlight through glass in the window or door 60. Then the shelf 32 may be slid out of an area immediately next to the window or door 60 to facilitate access to the window or door 60 and permit passage of items 58 through the space previously occupied by the shelf 32.

In some embodiments, additional shelves may be attached to the support members 16 above or below the shelf 32 previously described for a multi-tiered shelving unit. The rail 12 may also follow a non-linear path in some embodiments.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A suspended shelving apparatus comprising:

a rail configured for being mounted to a surface;

a plurality of support members, each support member of the plurality of support members being coupled to and extending downwardly away from the rail, each support member of the plurality of support members being slidable along the rail;

a shelf being coupled to a bottom end of each support member of the plurality of support members;

wherein each support member of the plurality of support members comprises:

a rod hanging from the rail, and a roller rotatably mounted proximate to an upper end of the rod, the roller engaging the rail such that the roller is rollable along the rail; and wherein each support member of the plurality of support members further comprises a retainer member fixedly mounted to the rod of the respective support member, the retainer member being positioned opposite the roller of the respective support member across the rail, the retainer member being positioned to engage the rail to prevent disengagement of the roller from the rail.

2. The apparatus of claim 1, wherein the rail follows a substantially linear path.

3. The apparatus of claim 1, wherein the roller has a perimeter surface which interlocks with a support surface of the rail.

4. The apparatus of claim 1, wherein the perimeter surface is concave.

5. The apparatus of claim 1, wherein the shelf is elongated in a direction parallel to the rail.

6. The apparatus of claim 1, further comprising a ceiling mount coupled to the rail and configured to mount to a ceiling.

7. The apparatus of claim 6, wherein the ceiling mount comprises a plurality of mount assemblies.

8. The apparatus of claim 7, wherein the support members are equally spaced from each other; and the mount assemblies are equally spaced from each other, a spacing between each adjacent pair of mount assemblies of the plurality of mount assemblies being equal to a spacing between each adjacent pair of support members of the plurality of support members.

9. The apparatus of claim 7, wherein each mount assembly of the plurality of mount assemblies comprises:

a rail member coupled to and extending away from the rail; and a ceiling member removably coupled to the rail member, the ceiling member being configured to mount to the ceiling.

10. The apparatus of claim 9, wherein the ceiling member is couplable via a threaded coupling to the rail member.

11. The apparatus of claim 9, wherein the ceiling member has a threaded distal end with respect to the rail member wherein the ceiling member is configured to mount to the ceiling via screwing the ceiling member into the ceiling.

12. A suspended shelving apparatus comprising:

a rail, the rail following a substantially linear path;

a plurality of support members, each support member of the plurality of support members being coupled to and extending downwardly away from the rail, each support member of the plurality of support members being slidable along the rail, the support members being equally spaced from each other, each support member of the plurality of support members comprising:

a rod hanging from the rail;

a roller rotatably mounted proximate to an upper end of the rod, the roller engaging the rail such that the roller is rollable along the rail, the roller having a perimeter surface which interlocks with a support surface of the rail, the perimeter surface being concave; and a retainer member fixedly mounted to the rod, the retainer member being positioned opposite the roller across the rail, the retainer member being positioned to engage the rail to prevent disengagement of the roller from the rail;

a shelf being coupled to a bottom end of each support member of the plurality of support members, the shelf being elongated in a direction parallel to the rail;

a ceiling mount coupled to the rail, the ceiling mount comprising a plurality of mount assemblies, the mount assemblies being equally spaced from each other, a spacing between each adjacent pair of mount assemblies of the plurality of mount assemblies being equal to a spacing between each adjacent pair of support members of the plurality of support members, each mount assembly of the plurality of mount assemblies comprising:

a rail member coupled to and extending away from the rail; and a ceiling member removably coupled to the rail member, the ceiling member being couplable via a threaded coupling to the rail member, the ceiling member having a threaded distal end with respect to the rail member wherein the ceiling member is configured to mount to a ceiling via screwing the ceiling member into the ceiling.

* * * * *